US007645202B2

(12) United States Patent
Lee

(10) Patent No.: US 7,645,202 B2
(45) Date of Patent: Jan. 12, 2010

(54) GOLF TEE

(75) Inventor: Lien-Hsin Lee, Luchou (TW)

(73) Assignee: Moldetk Precision Corp., Taipei Hsien (TW)

( * ) Notice: Subject to any disclaimer, the term of this patent is extended or adjusted under 35 U.S.C. 154(b) by 156 days.

(21) Appl. No.: 11/938,787

(22) Filed: Nov. 13, 2007

(65) Prior Publication Data

US 2008/0064532 A1 Mar. 13, 2008

Related U.S. Application Data

(63) Continuation-in-part of application No. 11/428,570, filed on Jul. 5, 2006, now abandoned.

(51) Int. Cl.
*A63B 57/00* (2006.01)

(52) U.S. Cl. ..... 473/393; 473/396

(58) Field of Classification Search ..... 473/387–403; D21/717–719

See application file for complete search history.

(56) References Cited

U.S. PATENT DOCUMENTS 1,550,483 A * 8/1925 Wulkop ..... 473/396
1,736,583 A * 11/1929 Deike ..... 473/396
2,668,710 A * 2/1954 Carlson ..... 473/393
5,033,747 A * 7/1991 Young ..... 473/391
5,211,395 A * 5/1993 Liao ..... 473/391
5,221,090 A * 6/1993 Hong ..... 473/391
5,242,170 A * 9/1993 Ward ..... 473/396
5,820,490 A * 10/1998 Hronas et al. ..... 473/391
2002/0123396 A1* 9/2002 Joo ..... 473/393
2003/0181262 A1* 9/2003 Lee ..... 473/396
2006/0105861 A1* 5/2006 Yang ..... 473/396
2006/0229144 A1* 10/2006 Lee ..... 473/393

* cited by examiner

*Primary Examiner*—Steven Wong

(57) ABSTRACT

A golf tee includes an anchoring device, which has a flat top head with a coupling portion and vertical through holes around the coupling portion and a nail body downwardly extending from the flat top head for fastening to the ground in a golf course, a receptacle member, which has a cup-like receptacle head for holding a golf ball for hitting and a shank downwardly extending from the bottom side of the cup-like receptacle head and provided with a transverse wire hole and a bottom coupling portion connectable to the coupling portion of the anchoring device, and a cord member inserted through the wire hole of the receptacle member and the through holes of the anchoring device to link the receptacle member to the anchoring device in such a manner that the cord member will not be tangled or jammed during installation of the anchoring device and the receptacle member is collectable for a repeated use.

9 Claims, 9 Drawing Sheets

GOLF TEE

This application is a Continuation-In-Part of my patent application, Ser. No. 11/428,570, filed on Jul. 5, 2006 now abandoned.

BACKGROUND OF THE INVENTION

1. Field of the Invention

The present invention relates to a golf tee for use in a golf game and more particularly, to a detachable golf tee, which comprises an anchoring device for fastening to the ground, a receptacle member for placing on the anchoring device to support a golf ball for hitting, and a cord member linking the receptacle member to the anchoring device.

2. Description of the Related Art

When playing golf game, a golf tee is usually used to support a golf ball for hitting with a golf club. The game involves many factors such as the player's physical size and mental condition, the tools used, the hitting posture and etc. A conventional golf tee is solid member made out of wood or plastics. A solid golf tee may break easily after a long use or when hit by a golf club. Further, when a player hit the golf ball, the golf tee may be forced to jump out of place, and the player may have to spend a lot of time to find the lost golf tee.

In view of the aforesaid problem, recollectable golf tees are developed. FIG. 8 illustrates a recollectable golf tee A according to the prior art. According to this design, the recollectable golf tee A is comprised of a receptacle A1, a first spring member A2, a second spring member A3, a barrel A4, a spring holder A5 and an anchor nail A6. When the player hits a golf ball, the receptacle A1 will be forced away from the anchor nail A6 and then immediately returned to its former position at the anchor nail A6 by means of the spring force of the first spring member A2 and the second spring member A3. This structure of recollectable golf tee A is complicated. When one component part of the recollectable golf tee A is damaged, the whole assembly becomes useless. Further, the spring members A3 and A4 wear quickly with use.

Further, during practice, the player must check one's posture and movement of the golf ball for reference in judging the performance. Further, an experienced golf player may judge the direction of rotation the golf ball and the performance subject to the biasing status of the golf tee after each hitting action. However, because the receptacle A1 is automatically returned to the anchor nail A6 after the golf ball is driven away, the player cannot judge the direction of rotation of the golf ball subject to the position of the receptacle A1.

There is also known a detachable golf tee, which is comprised of an anchor nail and a receptacle. After the player hit a golf ball, the player can check the drop location of the receptacle and judge the direction of rotation of the golf ball subject to the drop location of the receptacle. If the player hits the bottom side of the gravity center of the golf ball, the driving force of the golf club will force the receptacle to fall to the front side, and the golf ball will roll backwards after falling to the ground. If the player hits the top side of the gravity center of the golf ball, the driving force of the golf club will force the golf ball to rotate in counter-clockwise direction. Subject to the drop location of the receptacle, the player can judge the direction of rotation of the golf ball and the hitting performance. However, when the receptacle is driven away, the player may have to spend a lot of time to find the lost receptacle.

Therefore, it is desirable to provide a golf tee that eliminates the drawbacks of the aforesaid various prior art designs.

SUMMARY OF THE INVENTION

The present invention has been accomplished under the circumstances in view. According to one aspect of the present invention, the golf tee comprises an anchoring device for fastening to the ground in a golf course, a receptacle member for mounting on the anchoring device to support a golf ball for hitting by the golf player with a golf club, and a cord member linking the anchoring device and the receptacle member.

According to another aspect of the present invention, the cord member is inserted through a transverse wire hole on the shank of the receptacle member and through holes on the flat top head of the anchoring device, having two end stops respectively and fixedly provided at its two distal ends. Because the receptacle member and the anchoring device are movable relative to each other and the cord member is movable relative to the receptacle member and the anchoring device, the cord member will not be tangled or jammed when fastening the anchoring device to the ground and attaching the receptacle member to the anchoring device.

In an alternate form of the present invention, two receptacle members of different heights are linked to the anchoring device with two cord members. During the game, the player can selectively attach one receptacle member to the anchoring device subject to the type of the golf club selected, and the receptacle member that is not attached to the anchoring device can be used to guide the player's eyes toward the target, improving the hitting accuracy. Subject to the drop location of the receptacle member after each hitting action, the player can judge the direction of rotation of the golf ball and evaluate the performance.

DETAILED DESCRIPTION OF THE INVENTION

Figure 1:
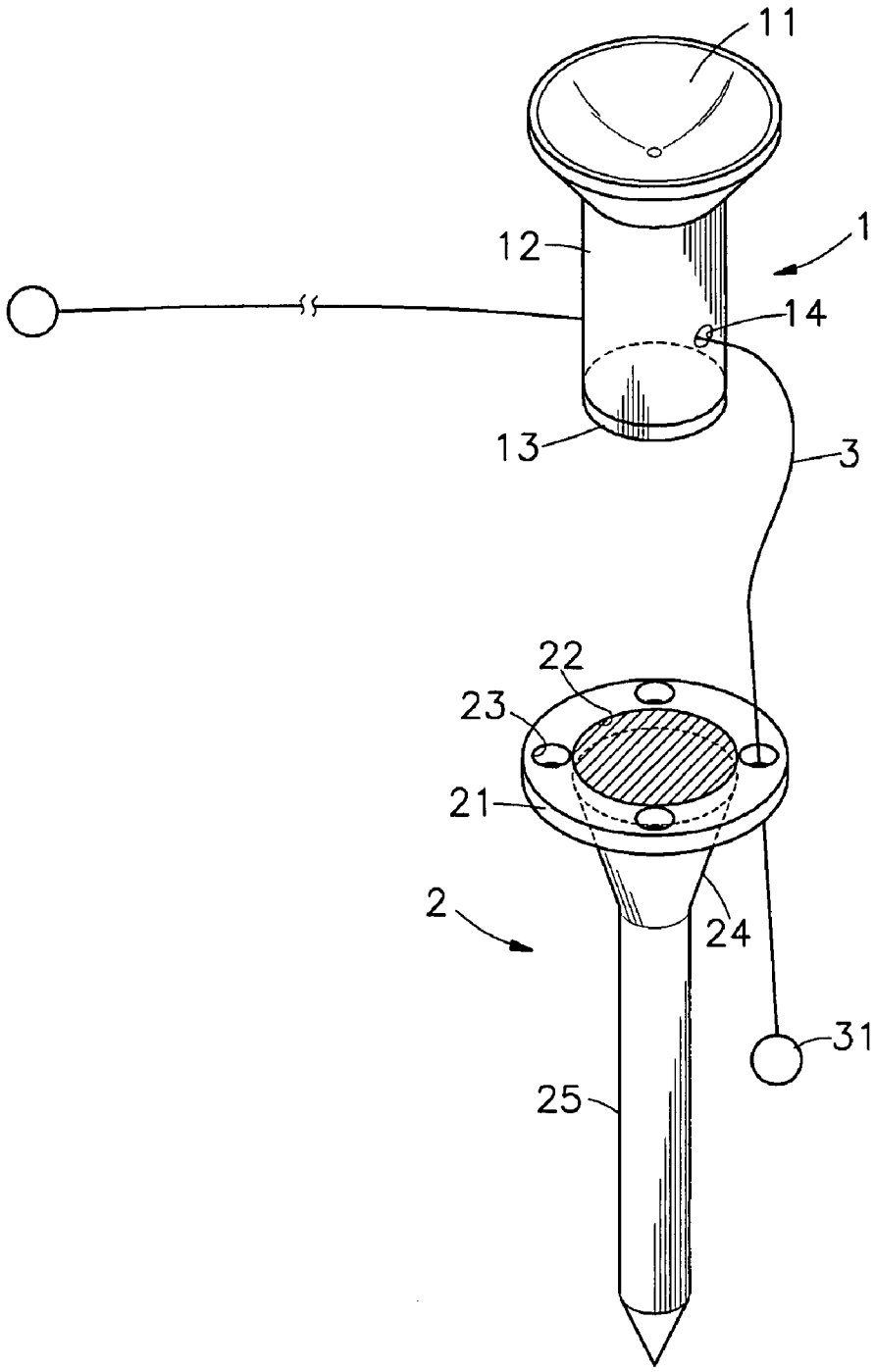
FIG. 1 is a perspective exploded view of a golf tee in accordance with a first embodiment of the present invention.

Referring to FIG. 1, a golf tee in accordance with a first embodiment of the present invention is shown comprised of a receptacle member 1, an anchoring device 2 and a cord member 3.

The receptacle member 1 has a cup-like receptacle head 11 for supporting a golf ball for hitting, a shank 12 vertically downwardly extending from the bottom side of the cup-like receptacle head 11, a coupling portion 13 disposed at the bottom side of the shank 12, and a wire hole 14 transversely cut through the shank 12.

The anchoring device 2 is a pointed bar that can be fastened to the ground to hold the receptacle member 1 for supporting a golf ball, having a flat top head 21, a coupling portion 22 located at the center of the top surface of the flat top head 21 for the positioning of the coupling portion 13 of the receptacle member 1, a nail body 25 for fastening to the ground, a shoulder 24 connected between the flat top head 21 and the nail body 25, and a plurality of through holes 23 vertically cut through and equiangularly spaced around the flat top head 21. The shoulder 24 can be made having any of a variety of shapes. According to this embodiment, the shoulder 24 is tapered, having a diameter gradually reduced from the flat top head 21 toward the nail body 25. According to this embodiment, the coupling portion 22 of the anchoring device 2 is a protrusion, and the coupling portion 13 of the receptacle member 1 is a coupling hole connectable to the protrusion of the coupling portion 22 of the anchoring device 2.

The cord member 3 is inserted through the wire hole 14 on the shank 12 of the receptacle member 1 and one through hole 23 on the flat top head 21 of the anchoring device 2, having its two distal ends respectively fixedly mounted with a respective end stop 3 that has a diameter greater than the wire hole 14 on the shank 12 of the receptacle member 1 and the through holes 23 on the flat top head 21 of the anchoring device 2. Therefore, the receptacle member 1 and the anchoring device 2 do not escape from the cord member 3.

Figure 2:
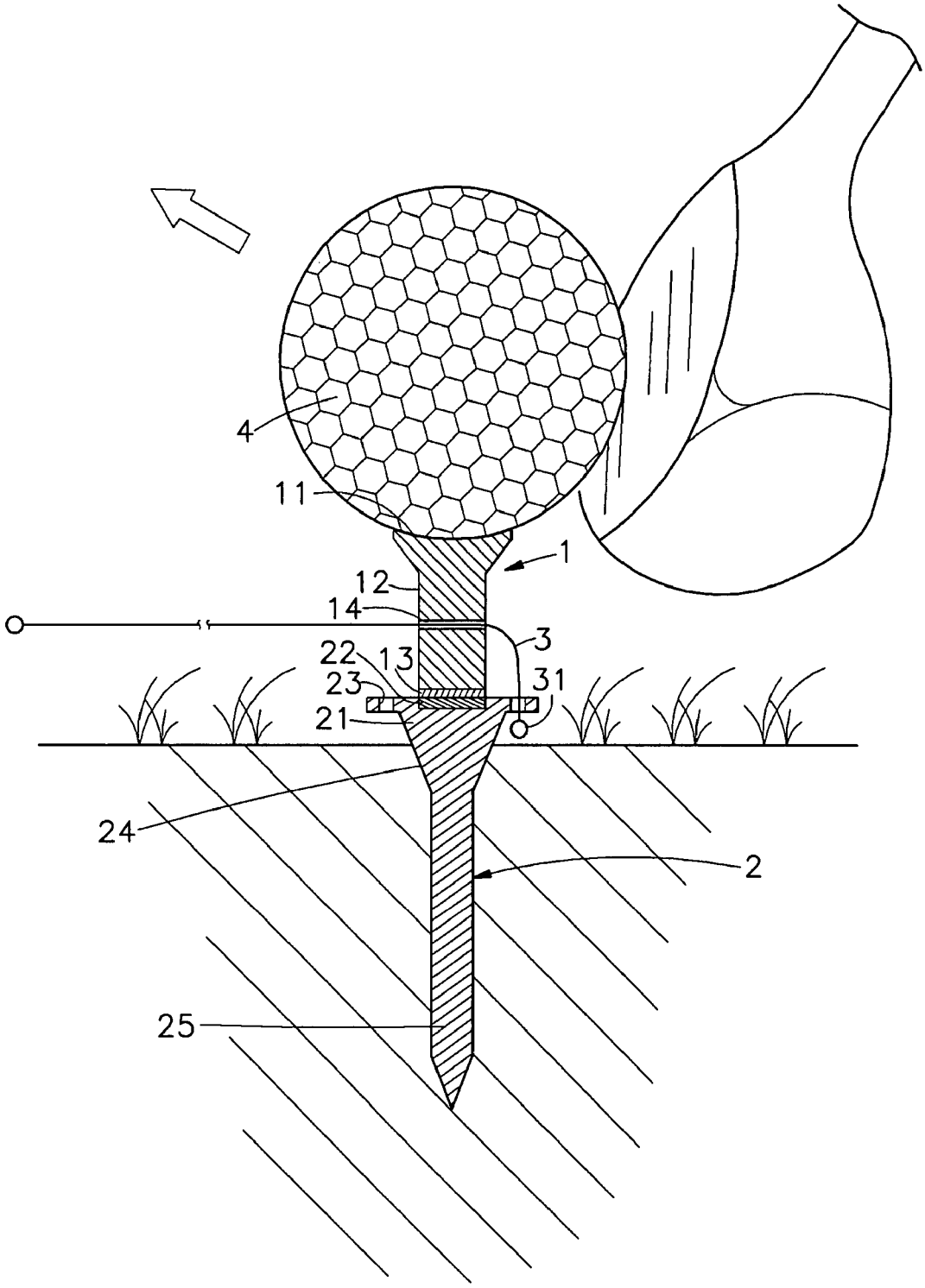
FIG. 2 is a schematic side view showing an application example of the golf tee according to the first embodiment of the present invention (I).
Figure 3:
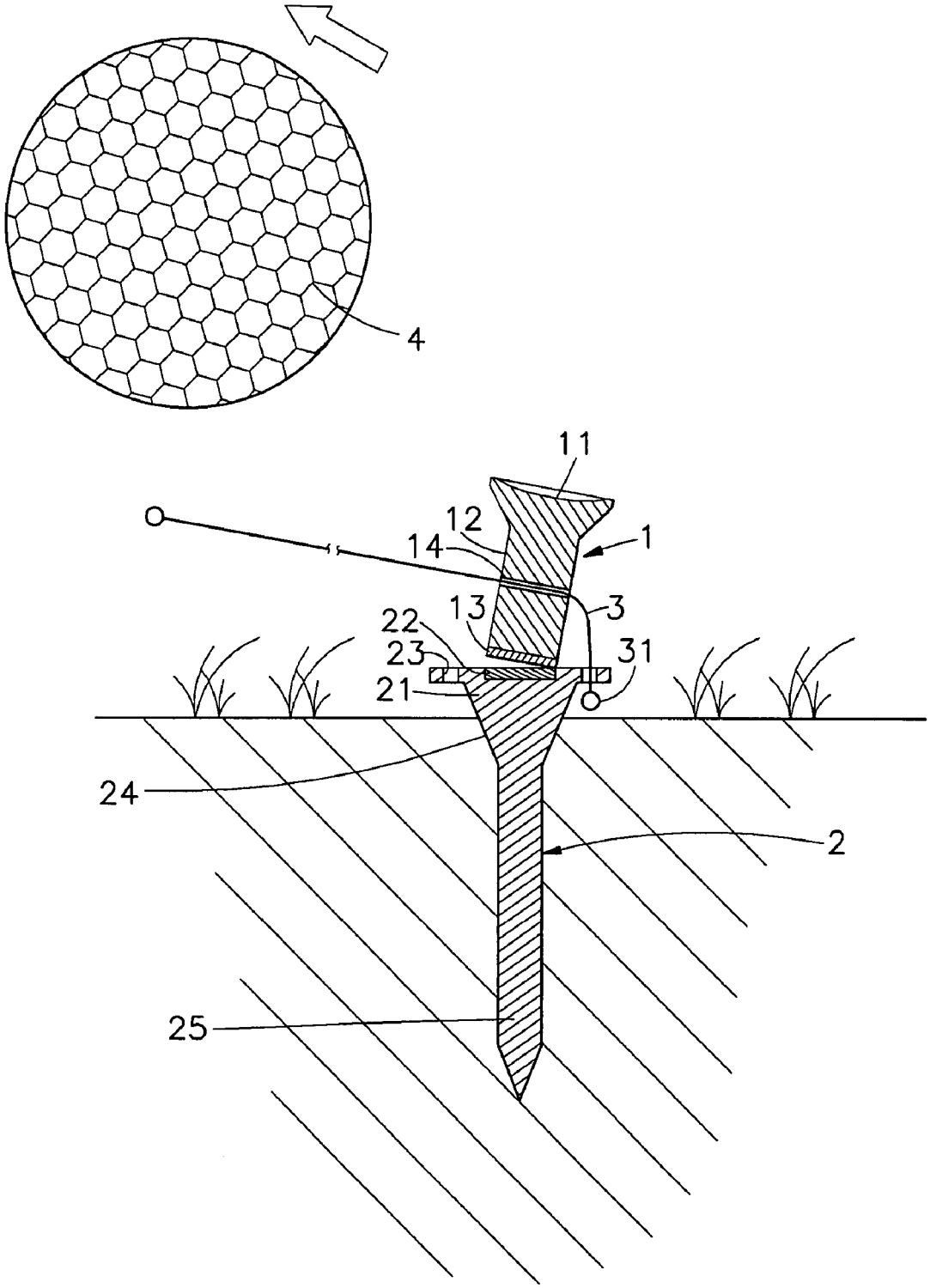
FIG. 3 is a schematic side view showing an application example of the golf tee according to the first embodiment of the present invention (II).
Figure 4:
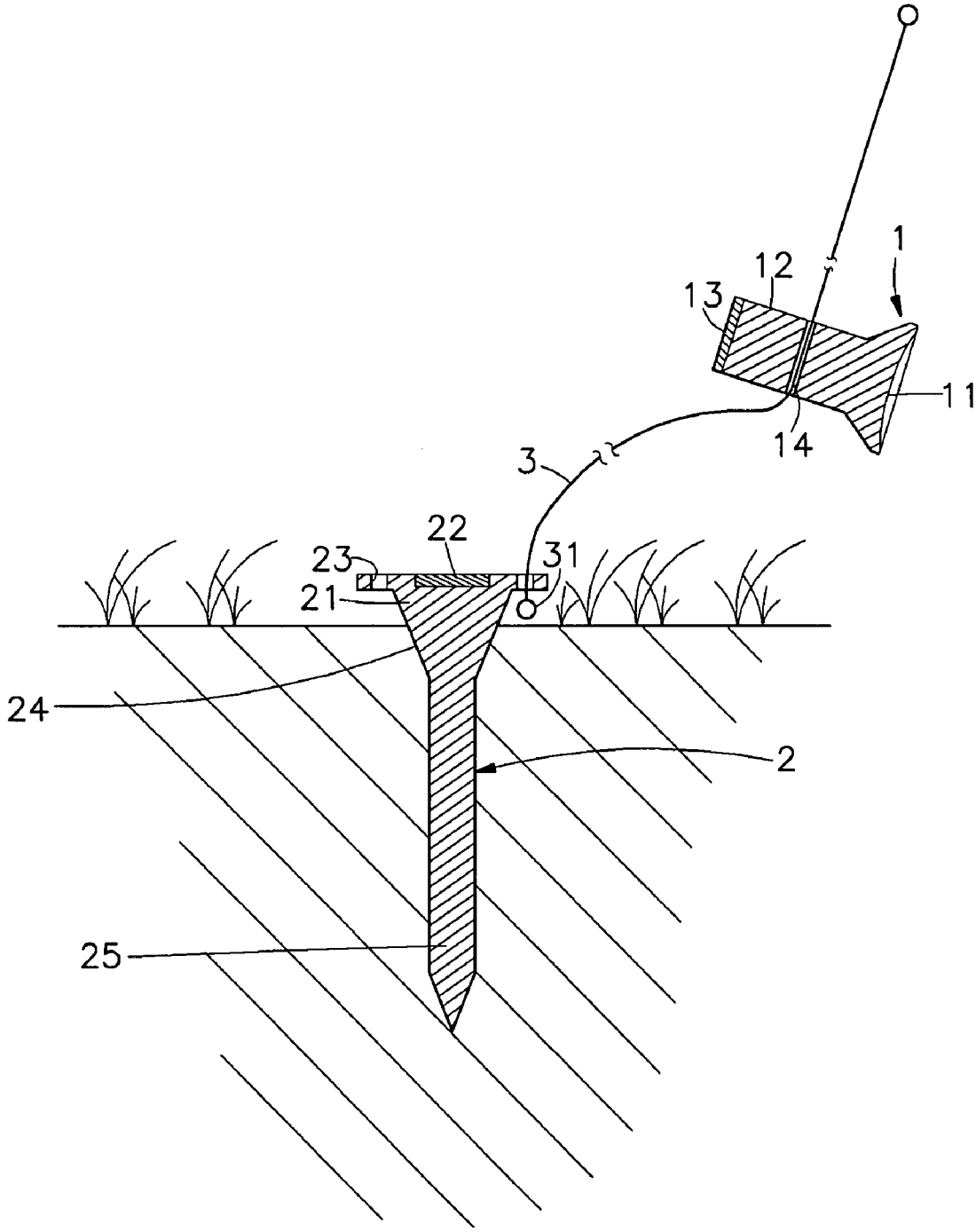
FIG. 4 is a schematic side view showing an application example of the golf tee according to the first embodiment of the present invention (III).

Referring to FIGS. 2~4, during use of the golf tee, the nail body 25 of the anchoring device 2 is fastened to the ground, and then the coupling portion 13 of the receptacle member 1 is fitted into the coupling portion 22 of the anchoring device 2, and then a golf ball 4 is placed on the cup-like receptacle head 11 of the receptacle member 1 for hitting. When a player hits the golf ball 4 with a club, the receptacle member 1 will fall from the anchoring device 2 and will be secured in place by the cord member 3 within a limited distance from the anchoring device 2. Therefore, the golf tee can be used repeatedly. Further, the player can grasp the flat top head 21 of the anchoring device 2 conveniently with the hand.

Referring to FIGS. 2~4 again, after the player hit the golf ball 4 and the receptacle member 1 fell from the anchoring device 2, the player can determine the direction of rotation of the golf ball 4 and evaluate the performance subject to the drop location of the receptacle member 1.

As stated above, the golf tee of the present invention is comprised of a receptacle member 1, an anchoring device 2 and a cord member 3 inserted through the wire hole 14 on the shank 12 of the receptacle member 1 and one through hole 23 on the flat top head 21 of the anchoring device 2 to secure the receptacle member 1 to the anchoring device 2 for allowing movement of the receptacle member 1 relative to the anchoring device 2 within a limited distance. By means of the coupling portion 22 at the flat top head 21 of the anchoring device 2 and the coupling portion 13 at the bottom end of the shank 12 of the receptacle member 1, the receptacle member 1 can be positioned on the top side of the anchoring device 2 to support a golf ball 4 for hitting.

Further, because the cord member 3 is inserted through the wire hole 14 on the shank 12 of the receptacle member 1 and one through hole 23 on the flat top head 21 of the anchoring device 2 to secure the receptacle member 1 to the anchoring device 2, the receptacle member 1 and the anchoring device 2 can be respectively moved relative to each other and relative to the cord member 3 within a limited range subject to the control of the cord member 3. Further, when the nail body 25 of the anchoring device 2 is fastened to the ground, the tapered shoulder 24 keeps the flat top head 21 spaced above the ground at a distance, preventing direct contact of the cord member 3 with the ground, and therefore the cord member 3 will not be tangled or jammed during the use of the golf tee.

Figure 5:
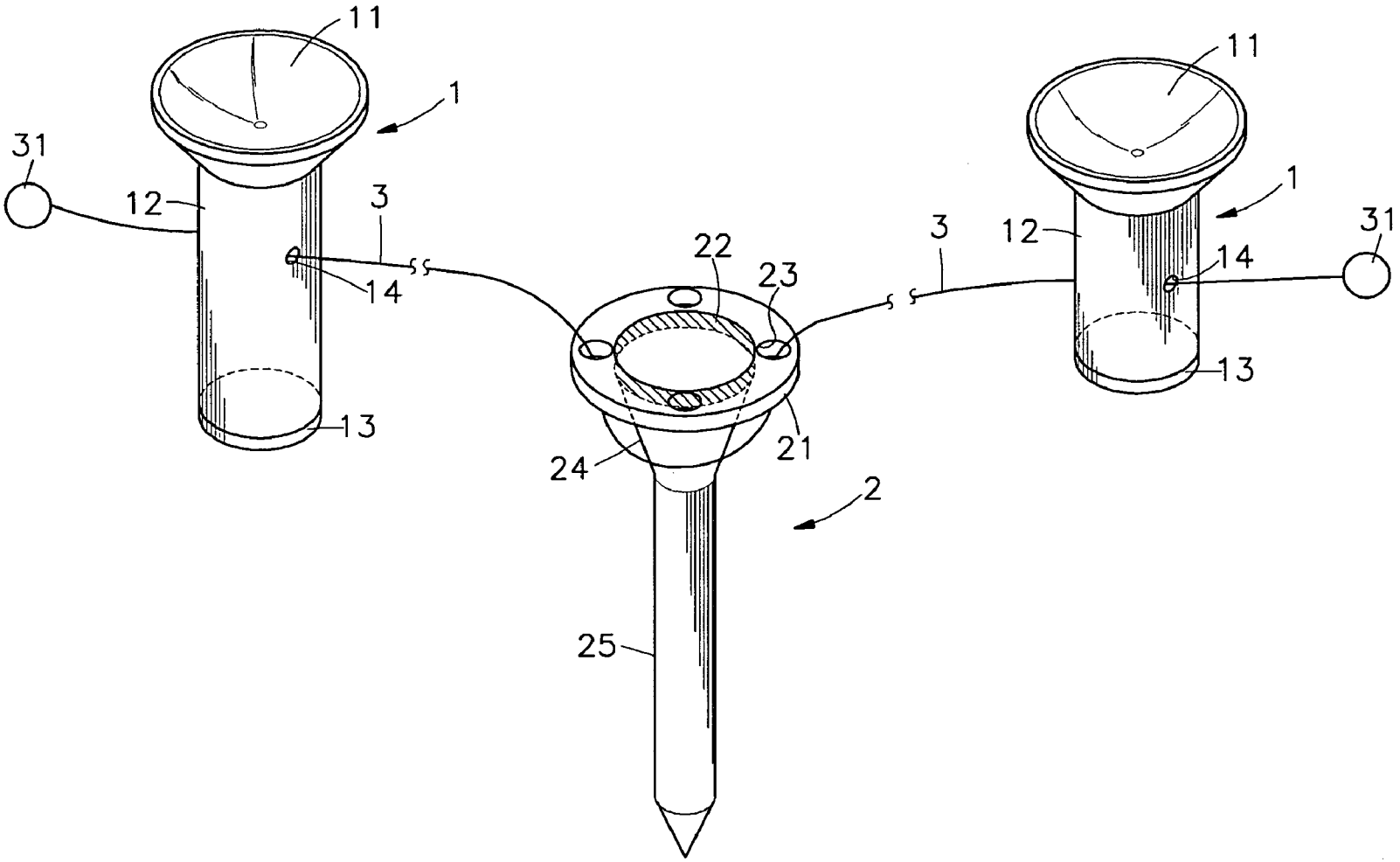
FIG. 5 is a perspective exploded view of a golf tee in accordance with a second embodiment of the present invention.

FIG. 5 shows a golf tee in accordance with a second embodiment of the present invention. According to this embodiment, one cord member 3 links two receptacle members 1 of different heights to one anchoring device 2. The cord member 3 is inserted through two opposite through holes 23 on the flat top head 21 of the anchoring device 2 with a middle part thereof suspending below the flat top head 21 and with the two distal ends thereof respectively inserted through the transversely extending wire hole 14 on the shank 12 of each of the two receptacle members 1 and then fixedly mounted with a respective end stop 31. When playing the golf game, the player can selectively attach one of the two receptacle members 1 to the anchoring device 2 subject to the type of the golf club (wood club or iron club) used. Further, the player can position the end stops 31 on one target line or two different target lines to guide the eyes when hitting the golf ball. After the player hit the golf ball, the user can determine the correctness of the performance subject to the drop location of the golf ball.

Figure 6:
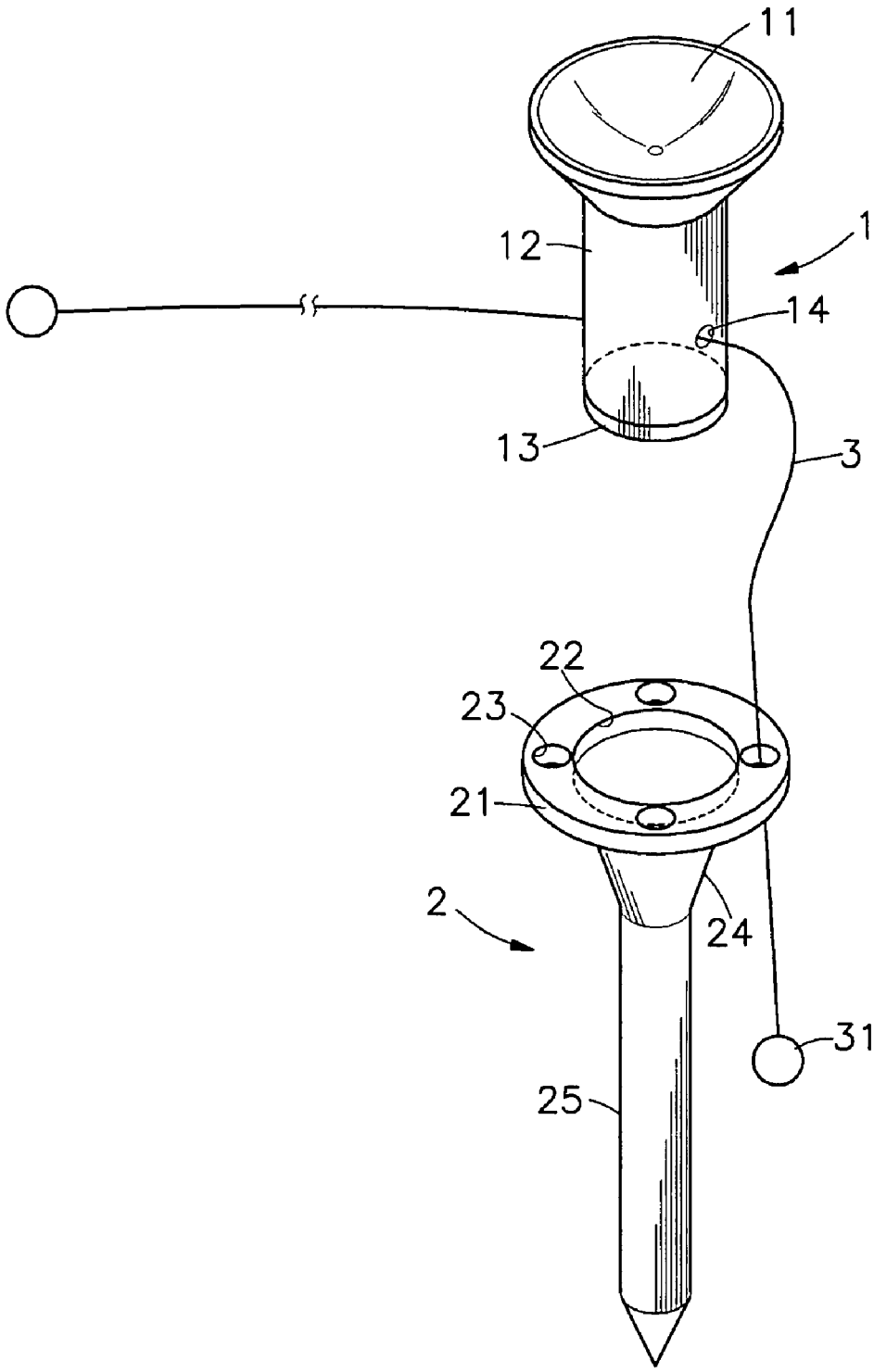
FIG. 6 is a sectional assembly view of a golf tee in accordance with a third embodiment of the present invention.

FIG. 6 is a sectional assembly view of a golf tee in accordance with a third embodiment of the present invention. This embodiment is substantially similar to the aforesaid first embodiment with the exception of the arrangement of the coupling portion 22 of the anchoring device 2 and the coupling portion 13 of the receptacle member 1. According to this third embodiment, the coupling portion 22 of the anchoring device 2 is a recessed hole, and the coupling portion 13 of the receptacle member 1 is a flange for fitting the recessed hole of the coupling portion 22 of the anchoring device 2. Further, magnetic means may be used so that the coupling portion 13 of the receptacle member 1 can be secured to the coupling portion 22 of the anchoring device 2 by means of magnetic attraction. For example, a magnet is provided at the coupling portion 13 of the receptacle member 1 or the coupling portion 22 of the anchoring device 2, and a magnetically attractive member is provided at the coupling portion 22 of the anchoring device 2 or the coupling portion 13 of the receptacle member 1 for attraction by the magnet.

Figure 7:
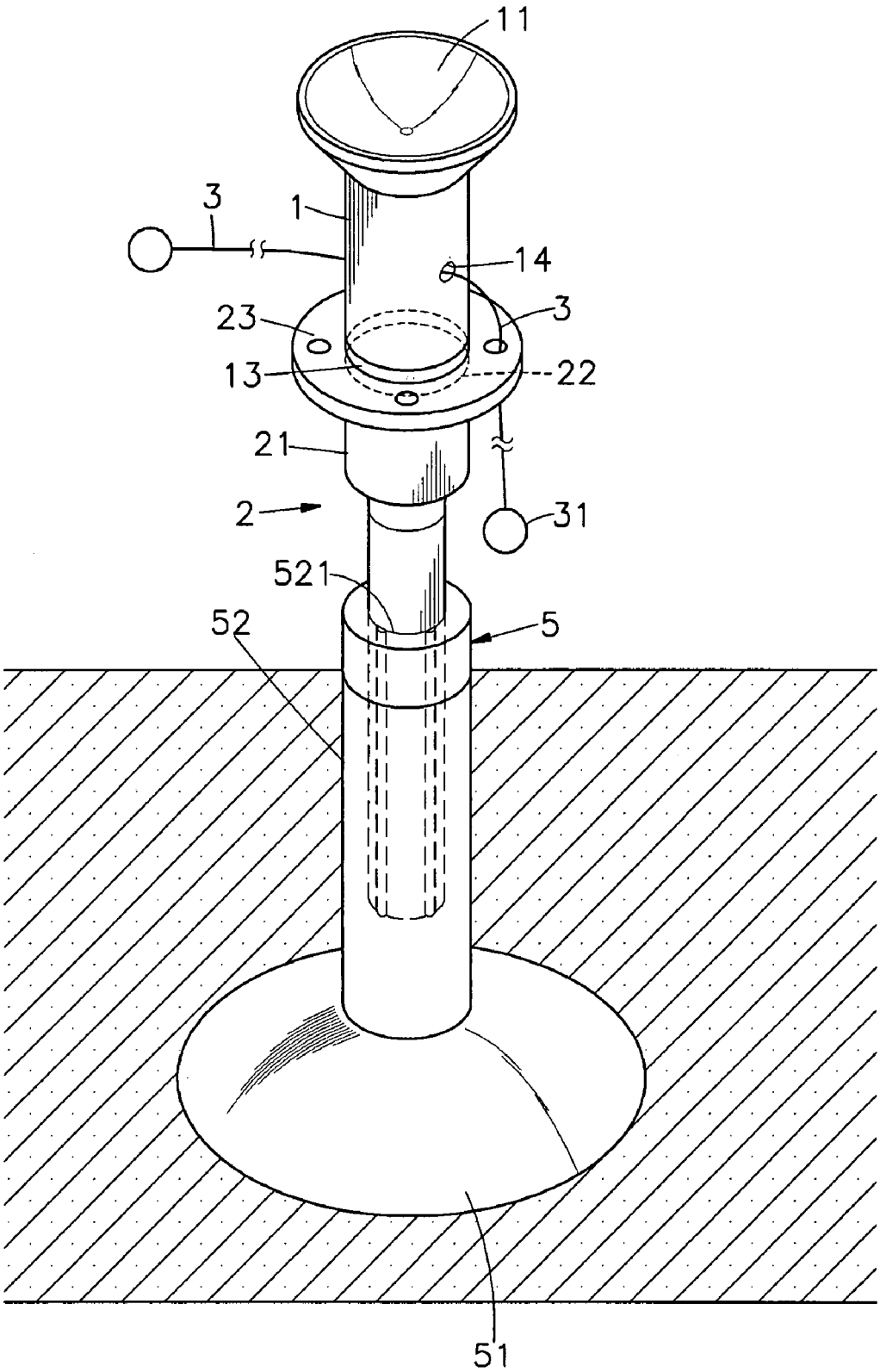
FIG. 7 is a perspective view of a golf tee in accordance with a fourth embodiment of the present invention.

FIG. 7 is a perspective view of a golf tee in accordance with a fourth embodiment of the present invention. According to this embodiment, the golf tee is comprised of a receptacle member 1, an anchoring device 2, a cord member 3 and a stand 5. The stand 5 comprises a base 51 for positioning on an artificial lawn or pad in a golf practice yard, and a hollow upright 52 vertically upwardly extending from the top center of the base 51. The hollow upright 52 has a vertical insertion hole 521 longitudinally downwardly extending from the top to a certain depth for the insertion of the nail body 25 of the anchoring device 2 to support the anchoring device 2 and the cord member 3 above the artificial lawn or pad in the golf practice yard.

Figure 8:
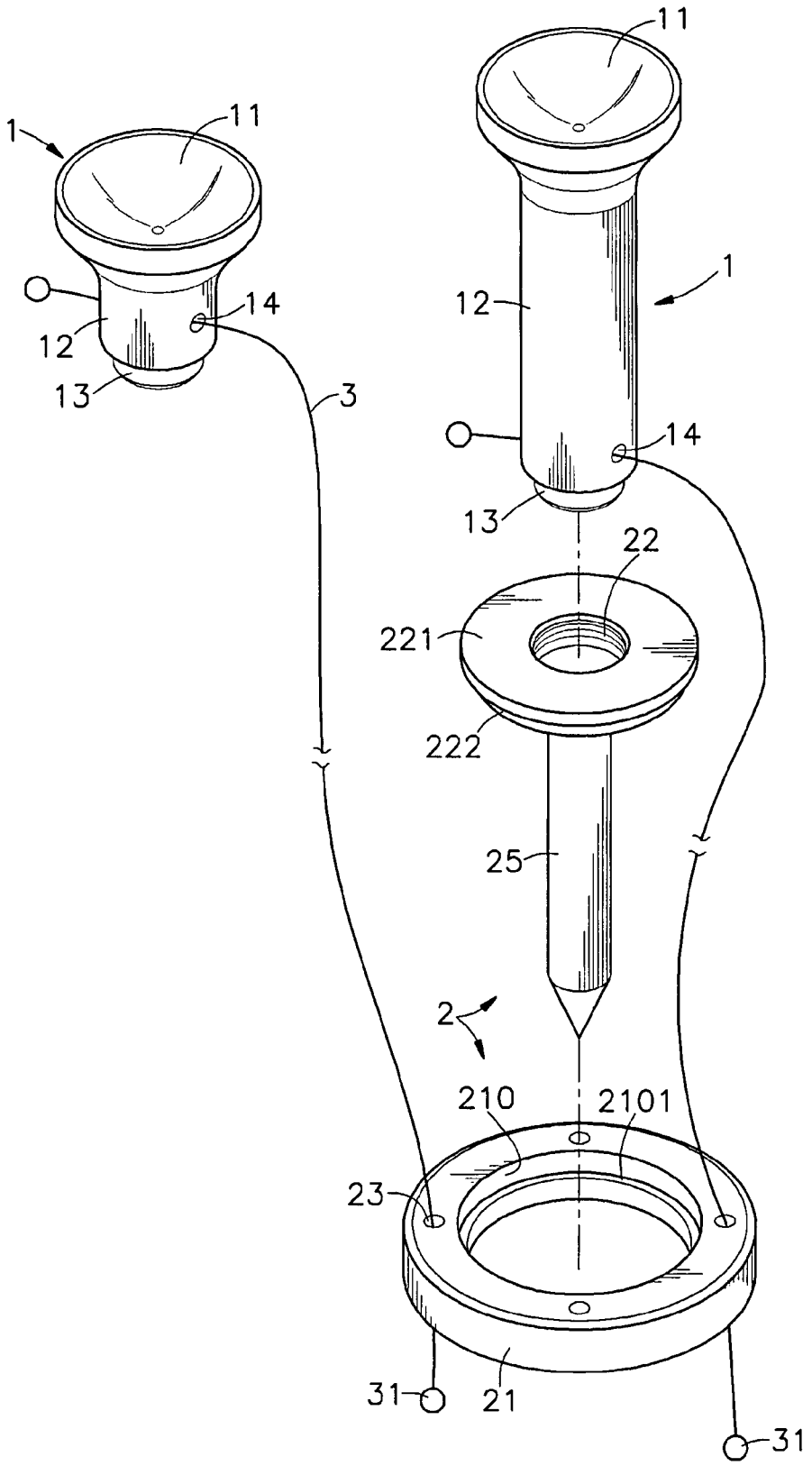
FIG. 8 is a perspective view of a golf tee in accordance with a fifth embodiment of the present invention.
Figure 9:
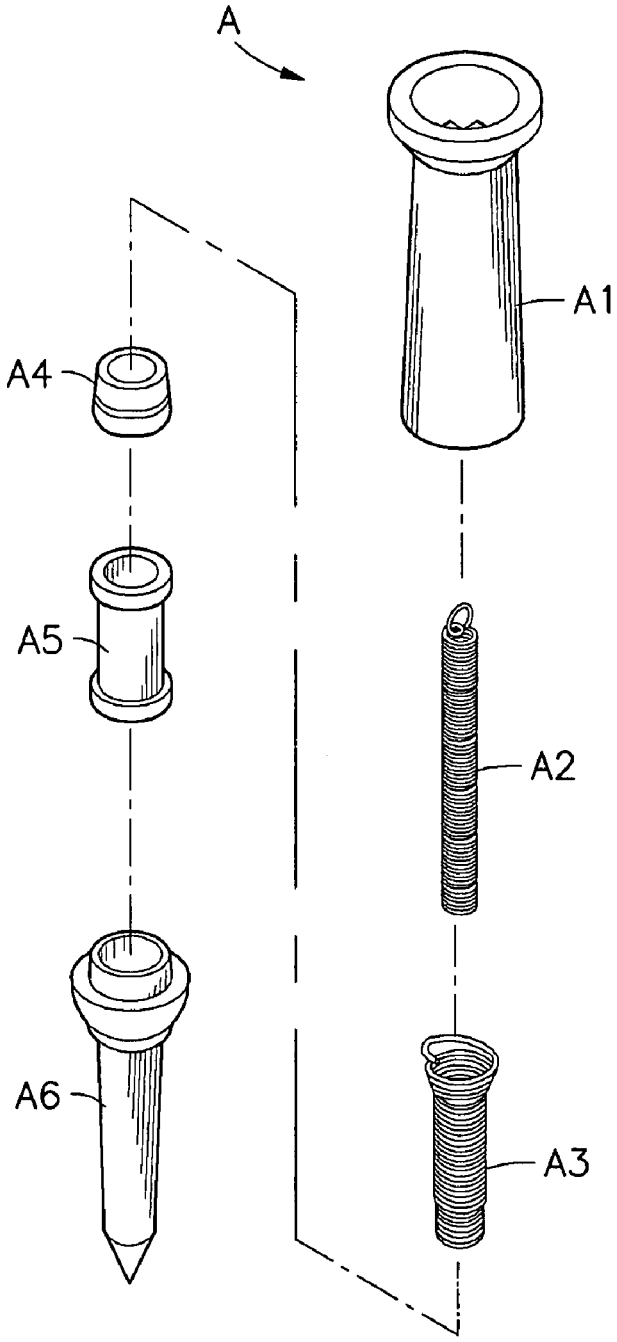
PRIOR ART FIG. 9
FIG. 9 is an exploded view of a golf tee according to the prior art.

FIG. 8 illustrates a golf tee in accordance with a fifth embodiment of the present invention. According to this embodiment, the golf tee is comprised of two receptacle members 1 that have different heights, an anchoring device 2 and two cord members 3. The receptacle members 1 each have a cup-like receptacle head 11 for supporting a golf ball for hitting, a shank 12 vertically downwardly extending from the bottom side of the cup-like receptacle head 11, a coupling portion 13 disposed at the bottom side of the shank 12, and a wire hole 14 transversely cut through the shank 12. The anchoring device 2 is comprised of two separated members, i.e., a flat top head 21 and a nail body 25. The top head 21 is an annular member having an inside step 2101 in a center opening 210 and a plurality of through holes 23 cut through the top and bottom sides and equiangularly spaced around the center opening 210. The nail body 25 has a flat top flange 221, a coupling portion 22 at the center of the flat top flange 221 for receiving the coupling portion 13 of one receptacle member 1, and a shoulder 222 at the bottom side of the flat top flange 221. The nail body 25 is inserted through the center opening 210 of the flat top head 21 with the shoulder 222 supported on the inside step 2101. Each cord member 3 is inserted through the wire hole 14 of one receptacle member 1 and one through hole 23 of the flat top head 21, having the respective two distal ends respectively and fixedly mounted with an end stop 31. The flat top head 21 and the nail body 25 are two separated members, therefore the nail body 25 can be separately replaced when damaged after a long use. Moreover, the golf tee can be divided into two separated components: (1) the nail body 25, and (2) the assembly of the flat top head 21, the cord member 3 and the receptacle member 1. The components of the golf tee of the present invention can be replaced by the player easily when damage or receptacle of the receptacle member 1 of different height is desired during a golf game.

Further, the cord members 3 can be a spring cord member made of metal, a rubber cord member or a conventional twisted cord member.

As described above, the golf tee of the present invention has the following features and benefits:

1. The cord member 3 is inserted through the wire hole 14 of the receptacle member 1 and the through hole(s) 23 of the flat top head 21 of the anchoring device 2 to link the receptacle member 1 to the anchoring device 2, allowing free movement of the receptacle member 1 relative to the anchoring device 2 within a limited range. When the player hits a golf ball, the receptacle member 1 can be forced to fall from the anchoring device 2 to the ground but kept linked to the anchoring device 2, and the player can pick up the receptacle member 1 for a repeated use.

2. The cord member 3 is inserted through the wire hole 14 of the receptacle member 1 and the through hole(s) 23 of the flat top head 21 of the anchoring device 2 to link the receptacle member 1 to the anchoring device 2. After the anchoring device 2 is fastened to the ground, the connection area between the cord member 3 and the anchoring device 2 is kept away from the ground. When fastening the anchoring device 2 to the ground, the player needs not to consider the direction of the cord member 3, and the cord member 3 will not be tangled or jammed during installation of the anchoring device 2.

3. By means of one or two cord member 3, two or more receptacle members 1 of different heights can be linked to the anchoring device 2, and the player can select one receptacle member 1 for positioning on the anchoring device 2 to support a golf ball for hitting subject to the type of golf club selected.

4. The cord member 3 has two end stops 31 respectively fixedly provided at its two distal ends. The player can use one end stop 31 to guide the eyes toward the target when hitting a golf ball. After hit, the player can judge the flying direction and direction of rotation of the golf ball as well as the correctness of the hitting posture subject to the drop location of the receptacle member 1.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A golf tee comprising, an anchoring device for fastening to the ground in a golf course, at least one receptacle member for mounting on the anchoring device to support a golf ball for hitting by a golf player with a golf club, and a cord member for linking the at least one receptacle member to the anchoring device, wherein:

the at least one receptacle member each comprises a cup-like receptacle head for supporting the golf ball for hitting, a shank vertically downwardly extending from a bottom side of the cup-like receptacle head, a wire hole transversely cut through the shank, and a coupling portion disposed at a bottom side of the shank;

the anchoring device comprises a flat top head, a plurality of through holes cut through top and bottom sides of the flat top head and equiangularly spaced along the periphery of the flat top head, a coupling portion located at the center of the flat top head for receiving the coupling portion of one of the at least one receptacle member to hold the receptacle member in vertical, and a nail body downwardly extending from the flat top head for fastening to the ground;

a cord member is inserted through the wire hole of each of a receptacle member and through one of the through holes of the anchoring device, having two end stops respectively and fixedly provided at two distal ends thereof that secure the cord member to the at least one receptacle member and the anchoring device for allowing free movement of the at least one receptacle member and the anchoring device along the cord member.

2. The golf tee as claimed in claim 1, wherein the anchoring device comprises a tapered shoulder connected between the flat top head and the nail body thereof.

3. The golf tee as claimed in claim 1, wherein the coupling portion of the anchoring device is provided with a magnet and the coupling portion of each of the at least one receptacle member is provided with a magnetically attractive member magnetically attractable to the magnet at the coupling portion of the anchoring device.

4. The golf tee as claimed in claim 1, wherein the coupling portion of each of the at least one receptacle member is provided with a magnet and the coupling portion of the anchoring device is provided with a magnetically attractive member magnetically attractable to the magnet at the coupling portion of each of the at least one receptacle member.

5. The golf tee as claimed in claim 1, wherein the coupling portion of the anchoring device is provided with a magnet and the coupling portion of each of the at least one receptacle member is provided with a magnet magnetically attractable to the magnet at the coupling portion of the anchoring device.

6. The golf tee as claimed in claim 1, wherein the flat top head of the anchoring device is an annular member having a plurality of through holes; the tee comprising a plurality of cord members and a plurality of receptacle members of different heights and wherein each of the cord members link a receptacle member to the anchoring device by a through hole.

7. The golf tee as claimed in claim 1, further comprising a stand for holding the anchoring device.

8. The golf tee as claimed in claim 1, wherein said nail body of said anchoring device is detachably attached to the flat top head of the anchoring device.

9. The golf tee as claimed in claim 8, wherein the flat top head of the anchoring device has a center opening and an inside step disposed inside the center through hole; the nail body is inserted through the center opening of the flat top head, having a flat top flange and a shoulder disposed at a bottom side of the flat top flange and supported on the inside step of the flat top head; the coupling portion of the anchoring device is located at the center of the flat top flange of the nail body.

* * * * *